United States Patent [19]

Chernack

[11] Patent Number: 4,572,689

[45] Date of Patent: Feb. 25, 1986

[54] DISPOSABLE APPLICATOR

[76] Inventor: Milton P. Chernack, 399 June Pl., West Hempstead, N.Y. 11552

[21] Appl. No.: 479,754

[22] Filed: Mar. 28, 1983

[51] Int. Cl.[4] ..... B43K 5/14; A45D 40/00

[52] U.S. Cl. ..... 401/132; 401/183; 132/79 A; 132/DIG. 3; 15/167 B

[58] Field of Search ..... 401/132, 133, 134, 173, 401/174, 176, 286, 287, 288, 289, 183, 184, 185, 186; 15/159 R, 159 A, 167 R, 167 B, 191 R, 191 A, 160, 190, 194, 201, 202, 204; 132/79 A, DIG. 3

[56] References Cited

U.S. PATENT DOCUMENTS

| | | | |
|---|---|---|---|
| 1,153,118 | 9/1915 | Kimes | 15/204 |
| 1,681,836 | 8/1928 | Boka | 401/288 |
| 1,716,739 | 6/1929 | Russel | 401/288 |
| 1,806,436 | 5/1931 | Withycombe | 15/194 |
| 2,516,778 | 7/1950 | Kreidenweiss | 15/191 A |
| 2,642,608 | 6/1953 | Hartmann | 15/194 |
| 3,393,962 | 7/1968 | Andrews | 401/132 |
| 3,792,699 | 2/1974 | Tobin et al. | 401/132 X |

*Primary Examiner*—Gene Mancene
*Assistant Examiner*—Carolyn A. Harrison
*Attorney, Agent, or Firm*—Cohen, Pontani & Lieberman

[57] ABSTRACT

Disposable applicator (10) for nail polish or other liquid comprises a frangible ampul (12) containing the liquid to be dispensed, a housing (14) defining a chamber (18) open at one end for housing the ampul (12), the housing (14) being flexible at least in the vicinity of the ampul (12), and an applicator (15) secured to the housing (14) at the open end of the chamber (18), whereby the housing (14) may be squeezed in the flexible vicinity thereof for breaking the ampul (12) whereupon the liquid may be transmitted to the applicator (15) through the open end of the chamber (18).

3 Claims, 2 Drawing Figures

DISPOSABLE APPLICATOR

TECHNICAL FIELD

This invention pertains to applicators for liquids such as nail polish.

BACKGROUND ART

Liquid applicators of the type under consideration are generally used for storing and dispensing nail polish and the like. Conventional applicators are usually in the form of a bottle having a cap. A brush depends from the underside of the cap such that the brush extends into the bottled polish when the cap is in place. Although the cap seals the bottle from the atmosphere, it has been widely observed that the volatile fraction of the polish evaporates over time, whereupon the polish becomes useless. Also, while immersion of the brush in the polish during nonuse preserves the brush, after repeated use some nail polish does dry on the brush and ultimately renders it unsuitable for continued use unless thoroughly cleaned.

Numerous arrangements have been suggested to overcome the above-mentioned disadvantages of the conventional prior art arrangement. A common feature of most is more effective sealing of the liquid reservoir from the atmosphere even during use, and retraction of the brush into the reservoir during periods of nonuse. For example, U.S. Pat. No. 1,044,996 issued to Cuthbertson, U.S. Pat. No. 2,547,287 issued to Sanders et al and U.S. Pat. No. 3,035,299 issued to Gordon et al disclose brush-type liquid applicators wherein a piston cylinder arrangement is employed for dispensing liquid to the brush and for moving the brush out of the reservoir where it is retained during nonuse. U.S. Pat. No. 2,630,593 isued to Jockers, U.S. Pat. No. 2,872,694 issued to Hopkins disclose brush-type applicators wherein dispensing of the liquid and movement of the brush out of the reservoir are gravity activated. U. S. Pat. No. 2,945,252 issued to Martineau, U.S. Pat. No. 3,341,884 issued to Pryor and U.S. Pat. No. 3,565,540 issued to Andrews disclose applicators which employ a compressible reservoir for dispensing liquid to the brush.

Regardless of the improved effectiveness of the above-mentioned prior art devices in preventing exposure of the reservoir to the atmosphere and in avoiding drying of the dispensed liquid on the brush, it will be apparent that inasmuch as the reservoir must be exposed to the atmosphere during use, and inasmuch as all are intended for repeated use, such devices cannot entirely overcome these problems.

It is accordingly an object of the present invention to provide a nail polish applicator which completely and effectively seals the dispensed liquid from the atmosphere until used, and once used may be discarded.

It is a further object of the present invention to provide a device of the character mentioned which is sufficiently inexpensive to justify disposal after a single use.

DISCLOSURE OF THE INVENTION

The present invention is for a liquid applicator intended for disensing nail polish and the like which completely seals the dispensed liquid from the atmosphere until used, and which is intended to be discarded after a single use. In a basic embodiment, the applicator comprises a frangible ampul containing the liquid to be dispensed, a housing defining a chamber open at one end for housing the ampul, the housing being flexible at least in the vicinity of the ampul, and an applicator secured to the housing at the open end of the chamber. The flexible portion of the housing may be squeezed for breaking the ampul for transmitting the liquid to the applicator through the open end of the chamber for applicaton in the usual fashion.

Further features and advantages of the disposable applicator in accordance with the present invention will be more fully apparent from the following detailed description and annexed drawings of a presently preferred embodiment thereof.

BRIEF DESCRIPTION OF THE DRAWINGS

In the drawings, wherein like numerals represent like parts.

BEST MODE FOR CARRYING OUT THE INVENTION

Figure 1:
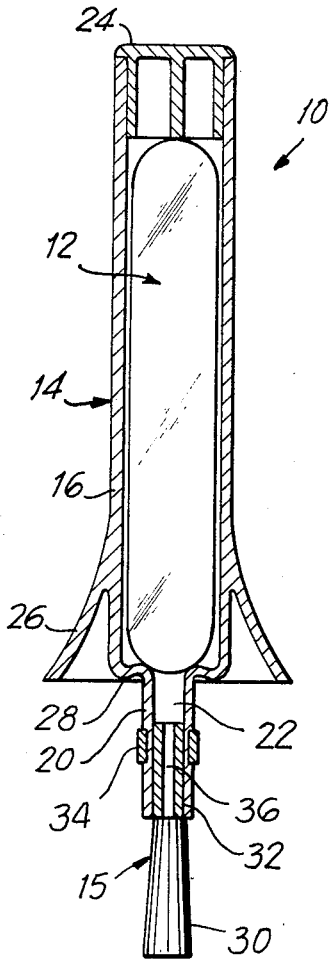
FIG. 1 is a vertical section of the preferred disposable nail polish applicator in accordance with the present invention.
Figure 2:
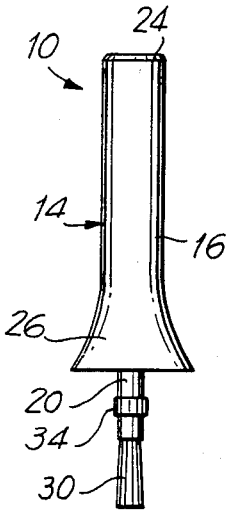
FIG. 2 is an elevational view thereof.

Referring now to the drawings, a preferred disposable nail polish applicator in accordance with the present invention is generally designated by the reference numeral 10. The principal components of the applicator 10 are an ampul 12, a housing 14, and a brush 15.

The liquid to be dispensed, for example, nail polish, is retained in the ampul 12 which is in the shape of a cylinder having rounded ends. The ampul 12 is frangible and may, for example, be comprised of onion skin glass.

Housing 14 has a main cylindrically shaped part 16 defining a cylindrical chamber 18 and a narrowed tubular secton 20 defining a passage 22 concentric with chamber 18 and communicating therewith. The end of the main housing part 16 opposite tubular section 20 is open ended for accommodating insertion of ampul 12. The housing 14 includes a cap 24 for sealing the open end of housing part 6 after ampul 12 has been inserted. Cap 24 may be frictionally secured to housing part 16 or fixedly secured thereto, such as by heat sealing or suitable adhesives. As shown, the ampul 12 is retained in the chamber 18 at one end by cap 24 and at the other end by the shoulder 28 defined between main housing part 16 and tubular section 20. For cosmetic reasons, the end of main housing part 16 opposite cap 24 is provided with a skirt 26. To enable the user to break the frangible ampul 12, housing 14 is comprised of a flexible material, such as polyethylene which may be squeezed sufficiently to break ampul 12.

Brush member 15 comprises bristles 30 and a tubular retainer 32 having a bore 36. As best shown in FIG. 1, the retainer 32 is dimensioned to be received in passage 22 of the housing section 20. In this position, one end of the bristles 30 is trapped between the inside wall of the housing section 20 and the outer wall of the retainer 32. A collar 34 is disposed about the housing section 20 at the upper end of retainer 32. The collar 34 serves to compress the housing section 20 against the retainer 32 for securing bristles 30 in place.

To use the device 10, housing 14 is grasped and squeezed in the vicinity of ampul 12 whereupon the ampul 12 breaks and releases the nail polish into chamber 18. By squeezing the housing 14, the nail polish flows from chamber 18 into passage 22 of the housing section 20. From there, the nail polish flows through the bore 36 of the retainer 32 and then on to the bristles 30 for direct application to the user's nails. The diameter of the bore 36 of retainer 32 is selected to obtain a desirable flow rate to bristles 30. Flow to the bristles 30 may also be controlled by the force with which the user squeezes the housing 14.

It is contemplated that after the device 10 is used once it will be discarded. The quantity of nail polish in the ampul is selected with such use in mind. For example, each ampul 12 may hold sufficient nail polish for the application of one coat to ten nails. If desired, the device 10 may be sold in kit form, with three devices in each kit, one containing the base coating, another the color coating, and a third the top coating. Because the device 10 is discarded after a single use, there is no possibility that unused nail polish will dry or that the bristles 30 will become inflexible from repeated use.

While the foregoing comprises a description of a preferred embodiment of the disposable nail polish applicator in accordance with the present invention, various changes and modifications therein will be apparent to those skilled in the art once this description is known. Accordingly, the above description is to be construed as illustrative, and not in a limiting sense, the scope of the invention being defined by the following claims.

I claim:

1. A disposable applicator for nail polish or other liquid comprising:

a frangible ampul containing the liquid;

a housing defining a chamber open at one end for housing said ampul, said housing being comprised of a flexible material and an integral section at said one end defining a passage of lesser cross-section than said chamber, said housing and said chamber being of cylindrical shape, said section being of tubular shape and said passage being concentric with said chamber;

an applicator secured to said housing at said open end of said chamber, said applicator comprising a plurality of elongated bristles and a tubular retainer having a through bore, said retainer being disposed in said passage with one end of said bristles disposed between the outer surface of said retainer and the inner surface of said tubular section; and a collar separate from said tubular secion and said retainer and disposed about said section in compressing relation thereto so that the inside surface of said passageway is compressed by said collar into sealing engagement with and to securely retain said bristles between said housing section and retainer, whereby said housing may be squeezed for breaking said ampul whereupon said liquid is transmitted to said applicator through said open end of said chamber and liquid flow from said chamber passes serially through said passage, through said bore and directly onto said bristles.

2. The disposable applicator of claim 1, wherein said housing further comprises a cap secured at the other end thereof for accommodating insertion of said ampul in said chamber.

3. The disposable applicator of claim 1, wherein said housing defines a shoulder between said chamber and said passage, said ampul being of greater cross section than said passage, whereby said ampul is supported in said chamber at said one end thereof by said shoulder.

* * * * *